United States Patent [19]

Nicolay

[11] 4,198,744

[45] Apr. 22, 1980

[54] PROCESS FOR FABRICATION OF FUSE AND INTERCONNECTS

[75] Inventor: Hugh C. Nicolay, Melbourne Village, Fla.

[73] Assignee: Harris Corporation, Melbourne, Fla.

[21] Appl. No.: 934,150

[22] Filed: Aug. 16, 1978

[51] Int. Cl.[2] ..... H01H 69/2

[52] U.S. Cl. ..... 29/623; 29/578; 357/51

[58] Field of Search ..... 29/623, 620, 578; 357/51, 67

[56] References Cited

U.S. PATENT DOCUMENTS

| | | | |
|---|---|---|---|
| 3,564,354 | 2/1971 | Aoki | 29/623 |
| 3,996,551 | 12/1976 | Croson | 29/620 |
| 4,032,949 | 6/1977 | Bierig | 357/51 |
| 4,135,295 | 1/1979 | Price | 29/623 |

*Primary Examiner*—Francis S. Husar
*Assistant Examiner*—Gene P. Crosby
*Attorney, Agent, or Firm*—Leitner, Palan, Martin & Bernstein

[57] ABSTRACT

Fuses and interconnects are fabricated by applying a metallic layer on a substrate and a fusible layer on the metallic layer. Portions of the fusible layer are removed to define discrete fuse elements having a necked portion. Portions of the metallic layer are removed to define interconnects. A portion of the metallic layer coextensive with the necked portion of the fuse elements is removed by selective side etching to form tapering portions separated by a gap without etching of the interconnects. The interconnects are protected from side etching by a separate mask layer or a mask layer used to form the interconnects may be heated to flow down over the sides of the interconnects.

9 Claims, 9 Drawing Figures

PROCESS FOR FABRICATION OF FUSE AND INTERCONNECTS

BACKGROUND OF THE INVENTION

1. Field of the Invention

The present invention relates generally to integrated circuits with fuse elements and more specifically to an improved method of making fusible elements and their interconnects.

2. Description of the Prior Art

Resistive thin film links or fuses are utilized in the design of monolithic integrated circuits as elements for the storage of information in a memory array and as elements for altering the configuration of the circuitry within the integrated circuit. Memories are programmed and circuit configurations altered by "blowing" appropriate fuses using circuitry provided for that purpose.

From a circuit design viewpoint, it is highly desirable to minimize the series resistance of the fuse element between the fuse neck region and the interconnect metal. Consistent with photo lithographics capabilities and alignment tolerances, the series resistance is minimized by locating the interconnect metal as close to the fuse neck as possible.

It is also desirable to minimize the power which must be applied to the fuse in order to "blow" or program the element. The power to blow is dependent, to some degree, upon the thermal conductivity of the environment of the fuse neck region.

Prior art fuse elements illustrated in FIGS. 1 and 2 generally included a substrate 10, an insulative layer 12, interconnects 14 and 16, wherein interconnect 14 is connected to the substrate 10 through an opening 18 in the insulative layer 12, and fusible element 20 having a neck portion 22. By forming the fuse 20 directly on the insulative layer 12, a high thermal conductivity of the environment is provided and consequently, more power is needed to blow the fuse. Similarly, there is a probability of the fuse element regrowing after programming. The opposed parallel edges of interconnects 14 and 16 at the connection to fuse 16 increases the fuse resistance.

To reduce the thermal conductivity environment of the fuse, the prior art device of FIGS. 3 and 4 was developed wherein the fuse 20 is formed on top of the interconnects 14 and 16 and separated from the insulative layer 12 by an air gap 24. In addition to providing a lower thermal conductivity, the gap 24 also decreases the probability of a fuse element regrowing after programming. The opposed parallel edges of connector 14 and 16 of the prior art device of FIGS. 3 and 4 provide the same series resistance fuse element as the fuse element of FIGS. 1 and 2.

The method of making the fuse structure similar to that illustrated in FIGS. 3 and 4 is described in U.S. Pat. No. 4,032,949. This process includes four layers of metal and a plurality of selective top etching and side etching to perform the suspended fuse structure.

Thus there exists a need for a process for fabricating fuses having a low thermal conductivity, a low series resistance, and a decreased probability of fuse element regrowth after programming.

SUMMARY OF THE INVENTION

The method of fabricating the present invention overcomes the problems of the prior art to form a suspended fuse element having a low thermal conductivity environment, low series resistance, and low probability of fuse regrowth after programming. The process includes forming a first metallic layer on an insulative layer of substrate, followed by the formation of a layer of fusible material. The fusible material is selectively removed to define the fuse element having a neck portion.

Preferably, a positive photoresist is applied between the application of the first metallic layer and the fusible layer such that the fuse may be defined by subsequent removal of the positive photoresist and the coextensive portions of the fusible layer. Selective portions of the first metallic layer are then removed by masking and etching to form interconnects. Finally, the portion of the first layer coextensive with the necked portion of the fuse element is side etched to form tapered extensions of the interconnects below the necked portion separated by a gap therebetween. The interconnects previously formed are protected during the side etching by a new mask layer or the mask layer used in the formation of the interconnects may be heated to a temperature sufficient to cause the mask material to flow down over the sides of the interconnects to form a protective layer. The tapered extensions of the interconnects below the necked portion reduce the series resistance of the fuse element and self-aligns the interconnects with the necked region. The gap there between provides the environment of a low thermal conductivity.

An object of the present invention is to provide a process for fabricating fuse elements and interconnects wherein the series resistance of the fuse element is minimized.

Another object of the invention is to provide a method of fabricating a fuse element and interconnect wherein the environment of the necked portion of the fused element has a low thermal conductivity.

Another object of the invention is to provide a method of fabrication wherein the interconnect layer is self-aligned to the necked portion of the fuse element.

Still another object of the present invention is to provide a fuse structure wherein the probability of regrowth of the fuse element is decreased.

Other objects, advantages and novel features of the invention will become apparent from the following detailed description when considered in conjunction with the accompanying drawings.

DESCRIPTION OF THE PREFERRED EMBODIMENTS

Figure 1:
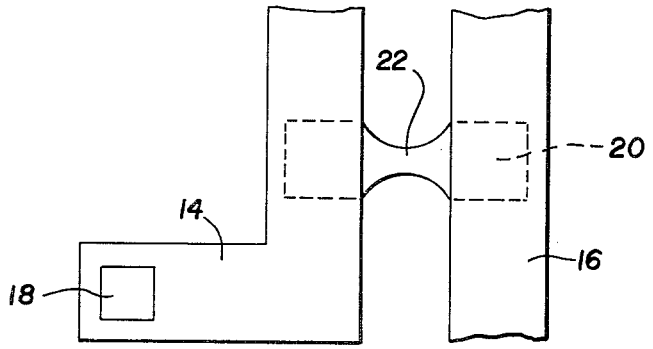
FIG 1 PRIOR ART
FIG. 1 is a topographical view of a fuse and interconnect of the prior art.
Figure 2:
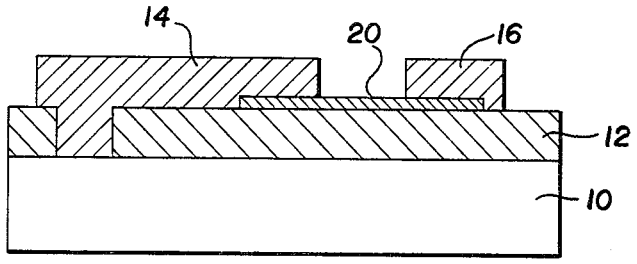
FIG 2 PRIOR ART
FIG. 2 is a cross-sectional view of the prior art fuse of FIG. 1.
Figure 3:
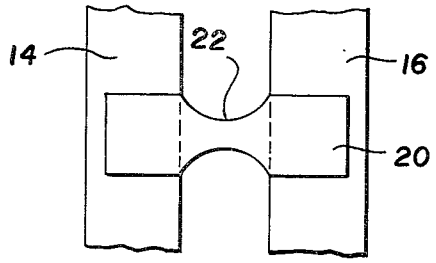
FIG 3 PRIOR ART
FIG. 3 is a topographical view of another prior art fuse and interconnect.
Figure 4:
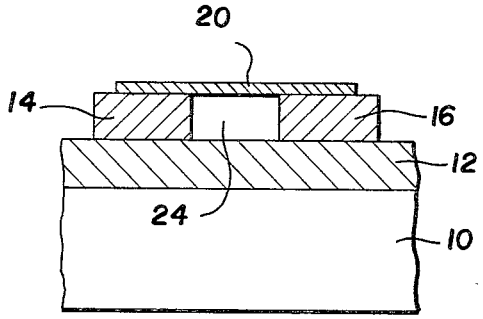
FIG 4 PRIOR ART
FIG. 4 is a cross-sectional view of the prior art fuse of FIG. 3.
Figure 5:
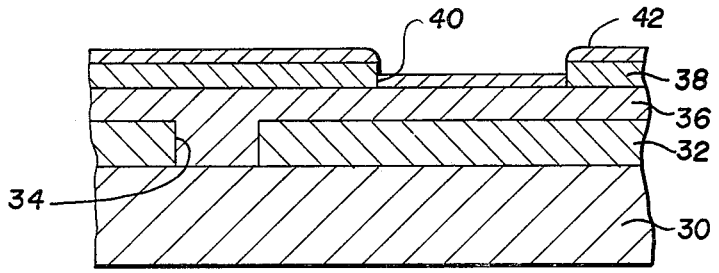
FIG. 5 is a cross-sectional view of a substrate at a stage of fabrication incorporating the principles of the present invention.

FIG. 5 illustrates a semiconductor substrate 30 having an insulating layer 32 thereon and a contact aperture 34 in the insulating layer. The substrate normally includes a plurality of semiconductor devices such as resistors, transistors, and diodes, with apertures like 34 opened in the overlying insulating layer 32 for the purpose of making contact to the terminals of these devices with interconnects. Substrate 30 may be a silicon substrate and the insulating layer 32 may be silicon oxide formed, for example, by thermal oxidation.

Subsequent to the formation of contact apertures 34, and appropriate cleaning of the contact apertures, a metallic layer 36, for example, aluminum, is deposited nonselectively over the surface of the insulating layer 32 and in the contact apertures 34. The metallic layer 32 may be applied by thermal evaporation, sputtering, or other means to a thickness of, for example, one micron. The surface of metallic layer 36 is then coated with a positive photosensitive resist material 38, exposed and developed to define the fuse elements. The polarity of the photoresist material 38 is such that the fuse element pattern is devoid of resist material at 40, for example.

A thin film layer of fusible material 42, for example, a nickel-chromium alloy under the trademark Nichrome is deposited on the patterned surface 38 and in opening 40. The layer of fusible material 42 is substantially thinner than the mask layer 38. For example, fusible material layer 42 may be in the order of 200 angstroms as compared to 6,000 angstroms for mask layer 38. The wafer at this stage of fabrication is illustrated in FIG. 5. The substrate is subjected to a chemical treatment which dissolves and removes the remaining photoresist material 38 and lifts away from the surface of the metallic layer 36 the thin film material 38 except in those areas, for example 40, wherein the thin film material 42 is in direct contact with the underlying metallic layer 36 to which it adheres. The resulting fuse 44 includes a necked portion 46.

Although a positive photoresist material and processing has been described, the formation and patterning of the fuse elements may be formed by standard negative photoresist techniques. This involves applying the thin film fusible layer 42 directly on the metallic layer 36, applying a photoresist film on top of the thin layer of fusible material 42, developing the negative photoresist material to form the fuse pattern and etching to remove the exposed portions of fusible layer 42. Using a negative photoresist technique, the etchant used must be capable of etching the fusible material of layer 42 without attacking the underlying metallic layer 36. The use of the positive photoresist technique is preferred since the photoresist covers and protects the underlying metallic layer 36 and consequently the to-be-formed interconnects have a higher reliability.

Figure 6:
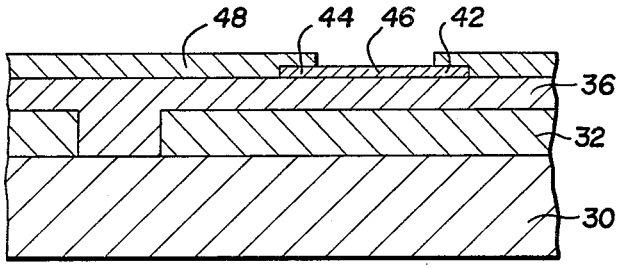
FIG. 6 is a cross-sectional view of the substrate incorporating the principles of the present invention at a state of fabrication subsequent to that of FIG. 5.

After the formation of fuse elements 44, a new photoresist layer 48 is applied and developed to define the interconnects for the various elements and to expose the fuse elements 44. The metallic layer 36 is selectively removed by using a suitable etchant which does not attack the exposed thin film fusible layer 42. For example, phosphoric acid could be used if the metallic layer 36 is aluminum and the thin film fusible layer 42 is Nichrome. The patterned photoresist layer 48 is illustrated in FIG. 6.

Figure 7:
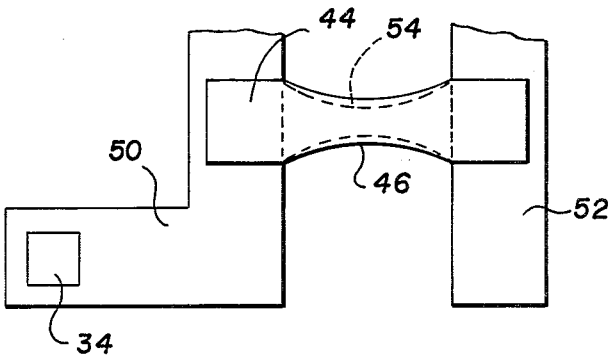
FIG. 7 is a topographical view of the substrate incorporating the principles of the present invention at a stage of fabrication subsequent to that of FIG. 6.

As a result of the etchant as illustrated in FIG. 7, a pair of opposed interconnects 50 and 52 are formed having the fuse element 44 extending thereacross. The fusible element 44 acts as a mask and minimizes the amount of side etching of the coextensive portion of metallic layer 36. The resulting coextensive portion is illustrated by the dotted lines 54 in FIG. 7.

After the interconnect pattern is etched, the substrate is subjected to the etching solution for additional time to side etch and undercut and remove the metallic layer portion 54 under the necked portion 46 of fuse 44. The absence of continuous metallic layer below the fuse element 44 can be determined by measuring the electrical resistance between the ends of the fuse element 44. The ends of the fuse will be electrically shorted or have very low resistance until a portion of the underlying layer 56 is removed to form a gap in the metal formed under the fuse between the two metallic interconnect regions 50 and 52. The additional etching time required to side etch and separate the metal layer 54 underlying the fuse neck 46 will normally also undercut and overetch the interconnects elsewhere on the substrate surface. Allowance is necessary in the design of the circuit to accommodate the final interconnect pattern.

Figure 8:
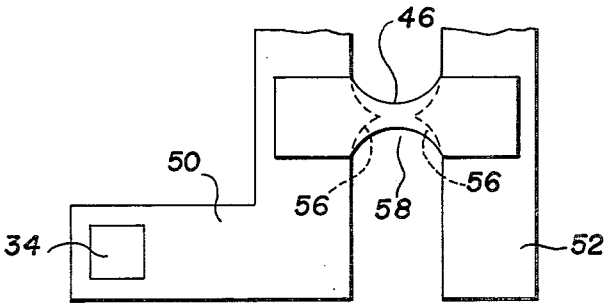
FIG. 8 is a topographical view of a fuse and interconnect formed according to the principles of the present invention.
Figure 9:
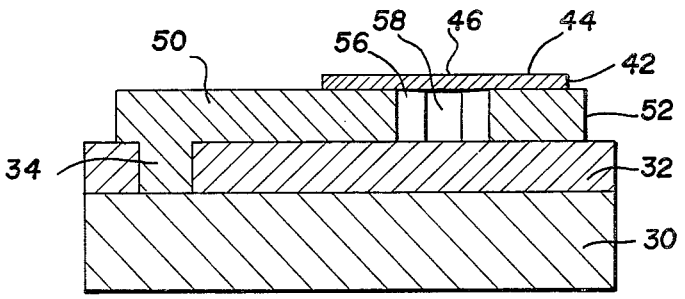
FIG. 9 is a cross-sectional view of the fuse and interconnect of FIG. 8 incorporating the principles of the present invention.

A preferred process to mitigate the undercutting and side etching of the interconnect is to bake the substrate at an elevated temperature after the interconnect pattern is formed but before the gaps are etched under the fused necks such that the photoresist material becomes semi-fluid and flows down over the edges of the interconnect metal pattern thus protecting the edges of the pattern from further attack by the etching solution. During the subsequent side etching, the portion 54 of metallic layer 36 is etched in a curve contouring the curvature of the necked portion 46. The resulting structure, as illustrated in FIGS. 8 and 9 has tapering portions 56 extending towards each other from opposed surfaces of interconnects 50 and 52 and separated from each other by a gap 58. The gap 58 and the forming of the fuse 46 atop of the interconnects 50 and 52 provide the desired low thermal conductivity environment and decrease the probability of the fuse element regrowing after programming. The tapering sections 56 of 50 and 52 are self-aligned with the necked portion and extend beyond the normal parallel surfaces of the interconnects 50 and 52. This reduces the series resistance of the fusible element since the low resistance interconnect extends over a greater portion of the fusible elements.

As an alternative process for protecting the interconnects and preventing additional undercutting and side etching, an additional photoresist sequence can be employed to completely protect the etched interconnects while exposing only the portion 54 of metallic layer 36 coextensive with the necked portion 46 of the fusible element. After the use of either process, the photoresist material is removed and the complete substrate is given an appropriate bake to stabilize the metalization system.

From the preceding description of the preferred embodiments, it is obvious that the objects of the present invention are attained in that a process is provided to fabricate a fuse element and interconnect system wherein the fuse has low series resistance, a low thermal conductivity environment, the necked region is self-aligned to the interconnects and the possibility of fuse element regrowth after programming is decreased. Although the invention has been described and illustrated in detail, it is to be clearly understood that the same is by way of example and illustration only and is not to be taken by way of limitation. The metallic layer 36, although being described as aluminum, may be of other metals, for example, gold or copper. Similarly, the fusible layer 42 has been described as Nichrome, but other fusible metals, for example, chrome or polysilicon, could be used. The spirit and scope of this invention are limited only by the appended claims.

What is claimed:

1. A method for fabricating thin film fuses on a substrate comprising:

applying a first layer of metallic material on said substrate;

applying a second layer of fusible material on said first layer;

first selectively removing portions of said second layer to define a fuse element;

second selectively removing portions of said first layer, except for portions coextensive with said fuse element, to define interconnects; and third selectively removing a portion of said coextensive portion of said first layer between the ends of said fuse element by side etching without affecting said fuse element and interconnects.

2. The method according to claim 1 wherein said second selective removal includes forming a mask layer on said substrate to define said interconnects with said fuse element exposed and etching through said mask and wherein said third selective removal includes heating said mask layer sufficiently to flow down over the edge of said interconnects and subsequently etching said portion of said coextensive portions.

3. The method according to claim 1 wherein said third selective removal includes forming a mask layer on said substrate to expose said fuse element and a portion of said coextensive portion of said first layer while protecting said interconnects and subsequently etching said portion of said coextensive portions.

4. The method according to claim 1 wherein a layer of positive photosensitive resist material is applied to said first layer and exposed to define said fuse element before the application of said second layer and said first removal includes removing said resist material and coextensive portion of said second layer.

5. The method according to claim 1 wherein said first layer is aluminum and said second layer is a nickel-chromium alloy and said second and third removals include etching with phosphoric acid.

6. The method according to claim 1 wherein said fuse element is defined to have a necked portion between its ends and said side etching performed to remove said coextensive portion of said first layer to form tapering portions of said first layer extending from opposed interconnects below said necked portion separated by a gap.

7. A method of fabricating thin film fuses and interconnects on a substrate comprising:

applying a first layer of metallic material on said substrate;

applying a second layer of fusible material on said substrate;

selectively removing portions of said second layer to define a discrete fuse element;

applying a mask layer on said substrate to define interconnects with said fuse element exposed;

etching through openings in said mask layer to form said interconnects;

heating said mask layer sufficiently to flow down over the edges of said interconnects; and side etching exposed portion of said first layer coextensive with said fuse element to remove a sufficient portion of said exposed portion of said first layer to form a gap under said fuse.

8. The method according to claim 7 wherein a layer of positive photosensitive resist material is applied to said first layer and exposed to define said fuse element before the application of said second layer and removal of said second layer includes removing said resist material and coextensive portion of said second layer.

9. The method according to claim 7 wherein said fuse element is defined to have a necked portion between its ends and said side etching is performed to remove said coextensive portion of said first layer to form tapering portions of said first layer extending between opposed interconnects below said necked portion separated by a gap.

* * * * *